US005154008A

United States Patent [19]

Chicot

[11] Patent Number: 5,154,008

[45] Date of Patent: Oct. 13, 1992

[54] INSTALLATION FOR TRANSPORTING AND/OR STORING PRODUCTS SENSITIVE TO CHANGES IN TEMPERATURE AND HUMIDITY

[76] Inventor: Denis Chicot, 9, rue Etex, 75018 Paris, France

[21] Appl. No.: 659,429

[22] PCT Filed: Sep. 7, 1989

[86] PCT No.: PCT/FR89/00448

§ 371 Date: Mar. 22, 1991

§ 102(e) Date: Mar. 22, 1991

[87] PCT Pub. No.: WO90/03321

PCT Pub. Date: Apr. 5, 1990

[30] Foreign Application Priority Data

Sep. 22, 1988 [FR] France ..... 88 12400

[51] Int. Cl.[5] ..... F26B 21/06

[52] U.S. Cl. ..... 34/73; 34/218; 62/447

[58] Field of Search ..... 34/218, 219, 73; 62/440, 447, 443, 441; 165/53

[56] References Cited

FOREIGN PATENT DOCUMENTS

| | | | |
|---|---|---|---|
| 534165 | 6/1955 | Belgium | 34/218 |
| 1283739 | 11/1968 | Fed. Rep. of Germany | 34/218 |
| 2947759 | 6/1981 | Fed. Rep. of Germany | 34/218 |
| 2163344 | 7/1973 | France | 34/218 |

*Primary Examiner*—Henry A. Bennet
*Attorney, Agent, or Firm*—Armstrong & Kubovcik

[57] ABSTRACT

The present invention relates to an installation for transporting and/or storing products sensitive to changes in temperature and humidity such as foodstuffs and in particular cocoa. The installation comprises a heat-insulated inner enclosure 1 containing such products and having upper and lower parts provided with openings 2, 3 to allow a surrounding gas such as air or a neutral gas to circulate through the inner enclosure. An outer enclosure surrounds the inner enclosure and is heat-insulated except for a portion of a its lower side walls. Means is provided for treating the circulating gas to reduce its relative humidity entering the inner enclosure to a value less than that of the gas-product equilibrium.

12 Claims, 2 Drawing Sheets

Figure 1:
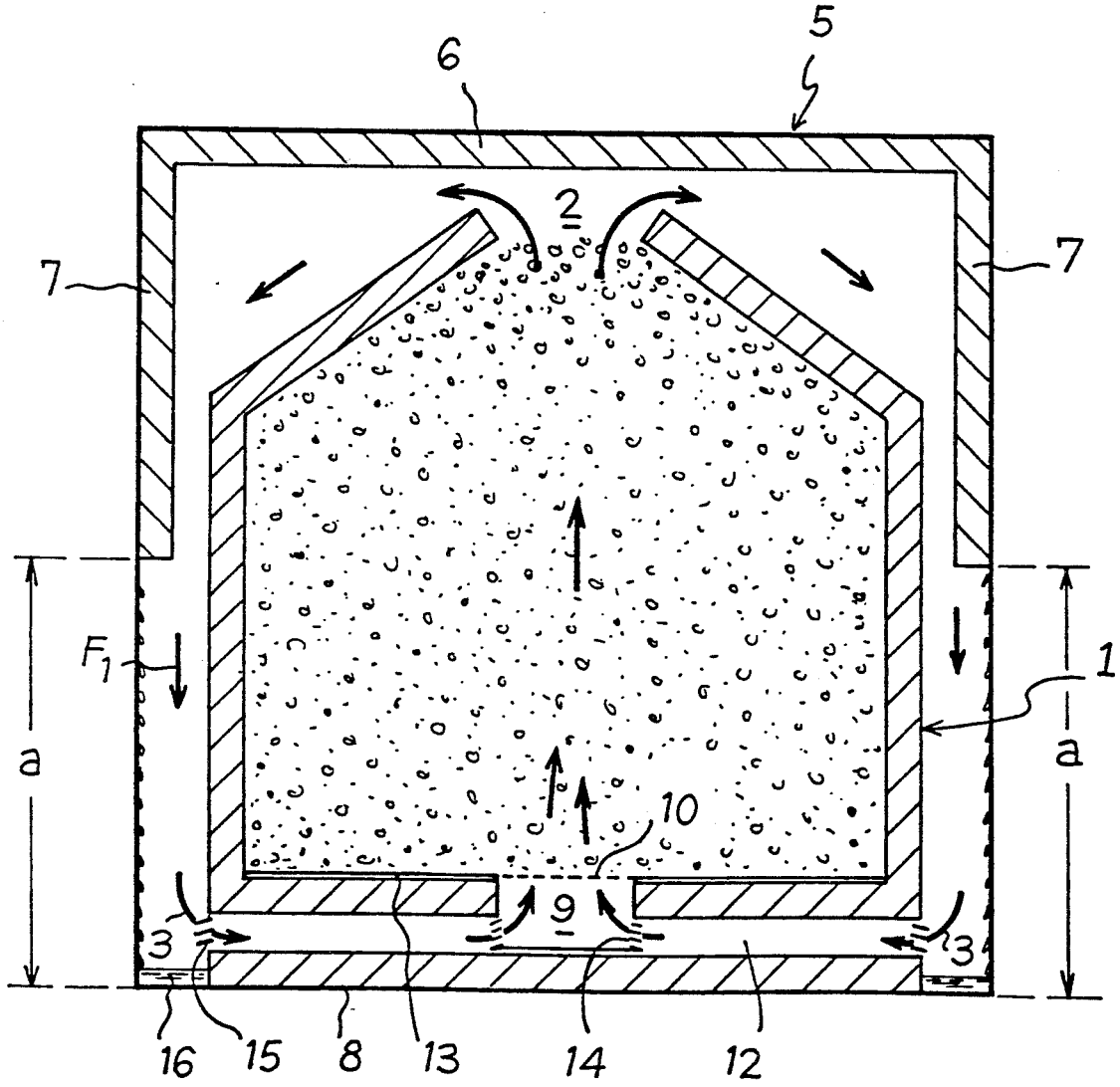

INSTALLATION FOR TRANSPORTING AND/OR STORING PRODUCTS SENSITIVE TO CHANGES IN TEMPERATURE AND HUMIDITY

The invention has for its object a novel installation for transporting and/or storing products sensitive to changes in temperature and humidity.

The present invention thus has two principal fields of application: storage and transport.

More precisely, the invention allows various storage installations to be produced, such as for example silos, stores, warehouses, etc. and transport installations such as for example large-dimensioned containers, bastard containers, crates, bags, cardboard boxes, packing cases, etc.

The products likely to be stored and/or transported, within the framework of the invention, are, on the one hand, powdery or granular products, such as in particular foodstuffs such as cocoa, and, on the other hand, any object or equipment sensitive to heat and demanding a limited hygrometry.

Within the particular domain of transport, the invention allows the transport of a very extensive range of goods between two countries whose local temperatures are very different.

Up to the present time, the transport of tropical agricultural products from producer countries with hot, damp climate towards consumer countries with temperate or cold climate, is inevitably accompanied by physical phenomena of desorption, adsorption and condensation, i.e. of transfer of humidity within the relatively closed volume constituted for example by a container or crate.

These physical phenomena are the origin of serious deteriorations of the products transported.

Certain systems set up in specialized containers, such as natural ventilation, double partition, double floor, false ceiling, absorbent material, etc. have been able to limit, slow down or delay the phenomena of desorption, but none has given entire satisfaction nor enabled the deteriorations in quality ascertained at arrival, particularly in the case of cocoa, to be avoided.

It is an object of the present invention to overcome the drawbacks set forth hereinabove, by proposing an installation for transporting and/or storing products sensitive to changes in temperature and humidity, of novel design, which makes it possible to avoid any degradation of the products even when the latter undergo, in time, considerable changes in temperature and/or humidity The invention is based on the application of the following three principles:

1. Regulate the heat transfers of the contents-container assembly, so that the temperature of the contents always remains higher than the humid temperature of the air (or of a neutral gas) in movement;

2. Use the movements of convection of the air (or a neutral gas) for transporting the calories and humidity of the mass of the contents towards a selected point of the container;

3. Reheat and dry the saturated air (or a neutral gas) before it comes into contact again with the product, by means of a heat exchanger.

More precisely, the solution according to the invention, to solve the technical problem raised, consists in an installation for transporting and/or storing products sensitive to changes in temperature and humidity, located in an environment of air or neutral gas undergoing movements of convection resulting in particular from variations in temperature, such as in particular foodstuffs such as cocoa, characterized in that it comprises:

a heat-insulated inner enclosure 1 which contains said products, having in its upper and lower parts at least one opening 2, 3 to allow air or a neutral surrounding gas to circulate through said inner enclosure 1;

an outer enclosure 5 surrounding said inner enclosure 1, which is heat-insulated with the exception of at least one part of its side walls, for example the lower part; and means for treating the air or neutral gas circulating through the inner enclosure 1 in order to reduce the relative humidity of the air or neutral gas entering the inner enclosure, preferably to a value less than the relative humidity of the air-product equilibrium.

The present invention thus makes it possible, for the first time, to master and order the physical phenomena of air/product equilibrium, avoiding the reductions in quality of the stored or transported product.

According to a particular embodiment of the invention, these treatment means comprise a heat exchanger.

According to another feature of the invention, the said heat exchanger is disposed on the path of circulation of the air or neutral gas, in the vicinity of the products, preferably in the lower part of said inner enclosure.

According to an advantageous embodiment of the invention, the said heat exchanger comprises an open cavity, preferably made inside the heat-insulated wall forming the bottom of the said inner enclosure, and opening out:

on the one hand, in its upper part in said inner enclosure, and on the other hand, for example via channels, in the volume included between said inner and outer enclosures.

This cavity is advantageously disposed substantially vertically with respect to the upper opening of the inner enclosure, so as to create a shaft for the circulation of the air or neutral gas.

According to a particular feature of the invention, the said heat exchanger comprises in addition a removable partition for separation from the products contained in the inner enclosure, made for example in the form of a grate possibly connected to a plate disposed at the bottom of said inner enclosure.

According to another advantageous feature of the invention, there may be provided in said cavity and/or in the condensate recovery zone, materials which are absorbent, adsorbent and/or which reinforce the thermal mass of the exchanger or the condensate recovery zone, for example steel wool.

This grate and this plate are advantageously made of a heat-conducting material thus producing a thermal bridge between the inner volume of the said cavity and the inner enclosure.

Figure 2:
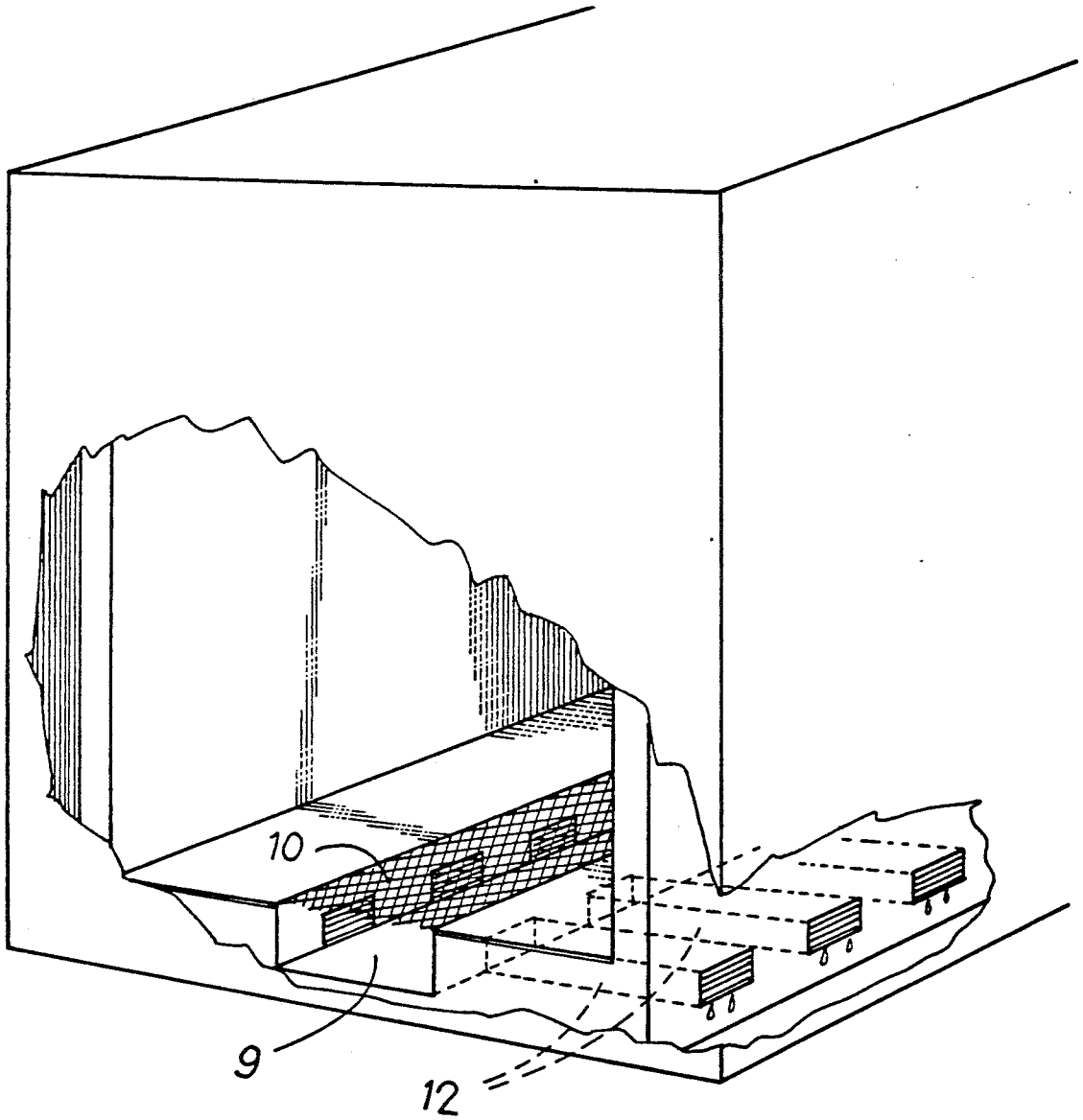

The invention will be more readily understood and other purposes, characteristics and advantages thereof will appear more clearly on reading the following explanatory description, made with reference to the accompanying schematic drawings given solely by way of non-limiting examples, illustrating a presently preferred embodiment of the invention and in which:

FIG. 1 is a view in principle in front section of an installation according to the present invention; and FIG. 2 is a partial view thereof in perspective with parts torn away, illustrating the part forming the heat exchanger of this installation.

To clarify the demonstration, it has been chosen to describe the invention within the particular framework of its application to the transport of tropical agricultural products from producer products (sic.) with a hot, damp climate, to consumer countries with a cold climate.

Naturally, it is question here only of a particular embodiment of the invention intended to make the different physical phenomena coming into play, more readily understood.

Taking the example of a product such as a cocoa bean, the conditions of air-product equilibrium at departure and at arrival make it possible to understand the transfers of humidity which are produced inside a container and the consequence thereof on the quality of the product transported.

When the container is closed in the producer country, the water content and the temperature of the product are generally homogeneous and the ambient air is rapidly placed in equilibrium with the product without significant variation in its water content, even if this air has a temperature and a hygrometry different from the conditions of equilibrium.

Alternations in humidity transfer, for example following a daily cycle including a night-time minimum and a day-time maximum, respectively lower and higher than the humid temperature of the inner air (dew point) are tolerable and do not lead to loss of quality of the product.

On the contrary, during transport by sea, the outside temperature decreases progressively until it becomes permanently lower than the humid temperature of the inner air.

The air-product equilibrium is thus broken and a considerable heterogeneity appears in the temperatures and the water contents of the product within its mass. In the case of cocoa, at the same time, mould develops and possibly heatings occur at certain spots.

Such phenomena are produced in any totally or partially closed volume and may be observed in all types of presently existing containers. In the particular case of isothermal containers, it is upon opening of the doors at arrival that these phenomena inevitably occur.

With reference to FIGS. 1 and 2, the specific arrangements of an installation according to the invention will now be described.

This installation comprises an inner enclosure 1 adapted to contain the products to be transported and/or stored. This enclosure 1 may be of any shape and dimensions and they will be chosen as a function of the shapes and dimensions of the products to be transported and/or stored.

The inner enclosure 1 is heat-insulated for example by means of insulating panels known per se, and comprises at least one opening in its upper and lower parts, allowing the circulation of air (or possibly of neutral gas) through the enclosure 1.

In the example shown, the enclosure 1 comprises an upper central opening 2 and a plurality of lower lateral openings 3 which will be described hereinafter.

This installation also comprises an outer enclosure 5 surrounding said inner enclosure 1 which, in the example shown, has a generally parallelepipedic form. The outer enclosure 5 is heat-insulated except for at least one part, for example the low part "a" of its side walls.

Thus the inner wall of the enclosure 5 is heat-insulated along its upper horizontal wall 6 and along the upper part 7 of its four vertical side walls.

Heat-insulation of the lower wall 8 of the enclosure 5 is ensured by the panel insulating the bottom of the inner enclosure 1 which rests on the bottom 8 of the outer enclosure 5.

Finally, the installation according to the invention comprises a heat exchanger which will be disposed on the path of circulation of the air or the neutral gas in movement, in the vicinity of the products, for example in the lower part of the inner enclosure 1.

In the presently preferred embodiment, this heat exchanger comprises an open cavity 9 opening out, on the one hand, in its upper part in the inner enclosure 1 and, on the other hand, via channels joining the openings 3, in the volume included between the inner (1) and outer (5) enclosures.

As shown in FIG. 2, the cavity 9 may be made in the form of a gutter, for example parallelepipedic, extending longitudinally in the median part of the inner enclosure 1, and communicating via an assembly of channels 12 extending parallel and transversely to said gutter, with the space included between the inner (1) and outer (5) enclosures.

According to a preferred variant embodiment, the cavity 9 and the channels 12 will be made in the panel insulating the bottom of the inner enclosure 1. The cavity 9 will preferably be disposed vertically, relatively to the opening 2, so as to create a "shaft" in which the air in movement will circulate.

This heat exchanger will comprise, in addition, a removable partition 10 for separating from the products contained in the inner enclosure 1. This partition will for example be made in the form of a perforated plate forming grate possibly connected to a plate 13 forming floor on which rest the products to be transported and/or stored. The cavity-grate-floor assembly thus constitutes the heat exchanger.

Of course, other types of heat exchangers may be used in place of the one which has just been described. In particular, an exchanger may be imagined, constituted by a tube traversing the floor and embedded in the mass of products to be transported and/or stored and of which the upper end is in the form of an upturned U, or any other type of exchanger.

Grates 14, 15 will advantageously be disposed at each end of the channels 12, of which the shape of the fins (shown schematically in FIG. 1) will enable the possible drops of condensation to be guided outwardly of the cavity 9 at the level of the orifice opening out in said cavity and outwardly at the level of the orifice opening out in the space included between the inner (1) and outer (5) enclosures.

Thanks to the presence of the removable grate 10, the cavity 9 is accessible by its upper part and products which are absorbent and/or adsorbent and/or of such nature as to increase the thermal mass of the exchanger, may for example be introduced.

The installation which has just been described functions as follows: When products are introduced in the inner enclosure 1, for example at the port of embarcation where the temperature is relatively high (for example 28° C.), the container-contents assembly goes into thermal equilibrium.

When the outside temperature decreases, the non-insulated part of the lateral walls cools the air which descends and moves in the direction indicated by the arrows.

When the outside temperature is lower than the dew point of the inner air, this inner air, whilst descending along the non-insulated part, is saturated, releasing water by condensation on the cold wall of the outer enclosure 5. The water of condensation trickles along this wall and is collected in a condensate recovery zone 16 located at the bottom of the enclosure 5, between the lateral walls opposite the inner (1) and outer (5) enclosures. The saturated, relatively cold air (for example 17° to 18° C.) enters the channels 12 via openings 3, then into cavity 9 which then acts as a heat exchanger since it is in direct vicinity of the mass of the products and consequently at the same relatively high temperature (27°/28° C.).

Taking into account the considerable specific heat of the products, the air entering cavity 9 is heated (for example to a temperature of 23°/24° C.) and its relative humidity decreases to a value less than the relative humidity of air-product equilibrium (for example 65 to 70%).

The air then heats up in contact with the product (for example up to a temperature of 25° C.) whilst being laden with humidity (tendency to air-product equilibrium).

Having arrived in the upper part of the natural shaft formed in the vertical plane of symmetry of the inner enclosure 1, the air attains a temperature and relative humidity which are substantially equal to those of the product (for example a temperature of 25° to 26° C. and a relative humidity of about 75%).

The air having passed through the mass of products leaves through the upper opening 2 and moves in the free space located in the inner and outer enclosures; the natural convection movement represented in FIG. 1 by arrows, being promoted by the cooling of the air located near the cold partition.

As will be understood, there is produced a cycle which progressively cools and dries the cocoa, without the appearance of the condensations and mould which are generally observed in the heretofore used containers.

The homogeneity and progressivity of the cooling and desicccation are obtained by the regulation of the heat transfers and of the humidity transfers.

Such regulation by convection results from the thermal and hydric exchange following from the specific conformation of the installation according to the invention.

To these transfers by convection are added transfers by conduction of the hottest zones towards the coldest zones of the mass, naturally reinforcing the effects of homogeneity and of progressivity.

The advantages of the installation according to the invention are therefore numerous.

In particular, the invention allows the transport and/or storage of a wide range of products. These products may be transported equally well in bags and in bulk, which makes it possible to benefit fully from the economical interest of the container.

The homogeneity and progressivity of the cooling and desiccation guarantee perfect conservation of the initial qualities and properties of the products.

It is obvious that the invention also covers a process for storing products affected by changes in temperature and/or humidity, such as in particular foodstuffs, for example cocoa, contained in devices in which said products are in an air or neutral gas environment undergoing movements of convection resulting in particular from variations in temperature, characterized in that there are provided:

a heat-insulated inner enclosure 1 adapted to contain said products and comprising in its upper and lower parts at least one opening 2, 3 allowing the circulation of air or of neutral gas through said enclosure;

an outer enclosure 5, surrounding said inner enclosure 1 and of which the inner wall is heat-insulated except for at least one part of its lateral walls, for example the lower part, and in that the air or neutral gas circulating through the products is treated so as to reduce the relative humidity of the air or neutral gas entering said inner enclosure, preferably to a value less than the relative humidity of the air-product equilibrium.

As will be understood, the present invention is based on a static heat exchange between a product contained in a partially or totally closed volume and the interstitial ambient gas (possibly air).

One of the originalities of the invention is that no mechanical means are used for controlling the temperature and/or hygrometric degree of a gas, but that a static heat exchanger is used.

I claim:

1. Installation for transporting and/or storing products sensitive to changes in temperature and humidity, located in an environment of a gas selected from the group consisting of air and neutral gas undergoing movements of convection resulting from variations in temperature, characterized in that the installation comprises:

a heat-insulated inner enclosure which contains said products, and having upper and lower parts wherein each of the upper and lower parts of said inner enclosure is provided with at least one opening to allow surrounding gas to circulate through said inner enclosure;

an outer enclosure having an upper and a lower part surrounding and spaced from said inner enclosure and heat-insulated with the exception of at least a portion of the lower part of said outer enclosure, whereby the inner and outer enclosures define an open space for free circulation of gas therebetween; and means for treating the circulating gas in order to reduce the relative humidity or the gas entering the inner enclosure to a value less than the relative humidity of the gas-product equilibrium.

2. Installation according to claim 1, characterized in that the said treatment means comprise a heat exchanger.

3. Installation according to claim 2, characterized in that said heat exchanger is disposed in the path of circulation of the gas, in the vicinity of the products, in the lower part of said inner enclosure.

4. Installation according to claim 2 and located in an environment of air or neutral gas undergoing movement of convection resulting in particular from variations in temperature, characterized in that said heat exchanger comprises an open cavity inside a heat-insulated wall forming a bottom of said inner enclosure, and wherein an upper side of the cavity communicates with said inner enclosure, and a lower side of the cavity communicates, via channels with a space between said inner and outer enclosures.

5. Installation according to claim 4, characterized in that said open cavity is disposed in substantially vertical alignment with respect to the upper, opening of the inner enclosure, so as to create a shaft for the circulation of the gas.

6. Installation according to claim 4, characterized in that said heat exchanger comprises a removable partition for separation of the products contained in the inner enclosure from the open cavity, said partition being in the form of a perforated grate disposed over the upper side of the open cavity.

7. Installation according to claim 5, characterized in that said heat exchanger comprises a removable partition for separation of the products contained in the inner enclosure from the open cavity, said partition being in the form of a perforated grate disposed over the upper side of the open cavity.

8. Installation according to claim 6, further comprising a plate disposed at the bottom of said inner enclosure, having an aperture corresponding to said open cavity, and forming a floor of said inner enclosure, and wherein said grate is connected to said plate about the periphery of said open cavity.

9. Installation according to claim 8, characterized in that the grate and the plate are made of a heat-conducting material thus producing a thermal bridge between the inner volume of said cavity and the inner enclosure.

10. Installation according to claim 7, further comprising a plate disposed at the bottom of said inner enclosure, having an aperture corresponding to said open cavity, and forming a floor of said inner enclosure, and wherein said grate is connected to said plate about the periphery of said open cavity.

11. Installation according to claim 4, wherein a lowermost portion of the space between the inner enclosure and the outer enclosure forms a condensate recovery zone.

12. Installation according to claim 11, wherein there is disposed in said cavity and/or in the condensate recovery zone a material selected from the group of materials which are moisture adsorbents, moisture adsorbents, and materials which reinforce the thermal mass of said heat exchanger and/or the condensate recovery zone.

* * * * *

UNITED STATES PATENT AND TRADEMARK OFFICE

CERTIFICATE OF CORRECTION

PATENT NO. : 5,154,008

DATED : October 13, 1992

INVENTOR(S) : Denis Chicot

It is certified that error appears in the above—identified patent and that said Letters Patent is hereby corrected as shown below:

Column 6, line 49, change "or" to ---of---.

Column 8, line 20, change "adsorbents" (first occurrence) to ---absorbents---.

Signed and Sealed this

Fifth Day of October, 1993

Bruce Lehman

BRUCE LEHMAN

*Commissioner of Patents and Trademarks*

*Attest:*

*Attesting Officer*